United States Patent [19]

Inoue

[11] 4,344,311

[45] Aug. 17, 1982

[54] RIVETER

[75] Inventor: Tadashi Inoue, Osaka, Japan

[73] Assignee: Lobster Tool Co., Ltd., Osaka, Japan

[21] Appl. No.: 223,079

[22] Filed: Jan. 7, 1981

[30] Foreign Application Priority Data

Mar. 19, 1980 [JP] Japan ..... 55-36032

[51] Int. Cl.[3] ..... B21J 15/34

[52] U.S. Cl. ..... 72/391

[58] Field of Search ..... 72/391, 114, 409; 29/243.5, 243.53

[56] References Cited

U.S. PATENT DOCUMENTS 3,280,615 10/1966 Molitor ..... 72/391
3,328,985 7/1967 Keymer ..... 72/391
3,426,572 2/1969 Lahnston ..... 72/391

FOREIGN PATENT DOCUMENTS 800427 8/1958 United Kingdom ..... 72/391

*Primary Examiner*—Gene Crosby
*Attorney, Agent, or Firm*—Nilsson, Robbins, Dalgarn, Berliner, Carson & Wurst

[57] ABSTRACT

A riveter comprises a turnable jaw case is disclosed. A jaw case tubular housing (170) is turnably supported by the forward end portion of the frame main body (101,) and lockable in a plurality of positions angularly spaced from each other. The orientation of the jaw case housing is easily changeable in accordance with the shape of the work to be riveted or with other conditions, so that rivets are settable very efficiently with only one riveter for any work irrespective of its shape.

3 Claims, 16 Drawing Figures

RIVETER

The present invention relates to a riveter comprising a lever pivoted to a frame main body and reciprocally turnable relative to the frame to reciprocate a jaw case.

Conventional riveters comprise a frame main body, a lever pivoted to the main body, a jaw case housing a jaw assembly and pivoted to the forward end of the lever, and a jaw case housing having the jaw case fitted therein and attached, either in a forward position or in a downward position, to the forward end of the frame main body. The lever, when turned, reciprocates the jaw case within the housing for setting rivets. Such riveters are disclosed in U.S. Pat. No. 3,280,615 and No. 3,328,985, and Japanese Patent Publication No. 30166/1973.

With riveters of the construction described, the jaw assembly is fixedly directed either forward or downwaard, to that when the forward-type riveter is not usable for the work to be riveted owing to its shape or other conditions involved, the downward-type riveter is used. Since one of the different types of riveters must be employed alternatively, the conventional riveters have the drawback of being very inefficient to use. Moreover, the two types of riveters need to be prepared at all times, hence uneconomical.

The present invention, which has been accomplished to overcome the foregoing drawbacks, provides a riveter comprising a turnable jaw case actuating support member disposed within a forward end portion of a frame main body and mounted on a pivot for supporting a lever on the frame main body, coupling means capable of locking the actuating support member in a plurality of positions relative to the lever and displaced from each other through a predetermined angle $\theta$, a jaw case turnably supported by the actuating support member eccentrically of the pivot and reciprocally movable straight by reciprocal turn of the lever through reciprocal turn of the actuating support member connected to the lever, and a jaw case tubular housing turnably supported by the forward end portion of the frame main body and lockable thereto in a plurality of positions angularly spaced from each other by the same angle as the angle of displacement $\theta$.

With the riveter of the present invention, the orientation of the jaw case enclosing a jaw assembly is easily changeable as desired in accordance with the shape of the work to be riveted or with other conditions involved. Rivets can therefore be set in place with a greatly improved efficiency using only one riveter for any work irrespective of its shape.

Embodiments of the present invention will be described below in detail with reference to the accompanying drawings, in which:

FIG. 9 being a view showing the mandrel pulled up with the lever in a half-closed position, FIG. 10 being a view showing the rivet completely set in place;

Figure 1:
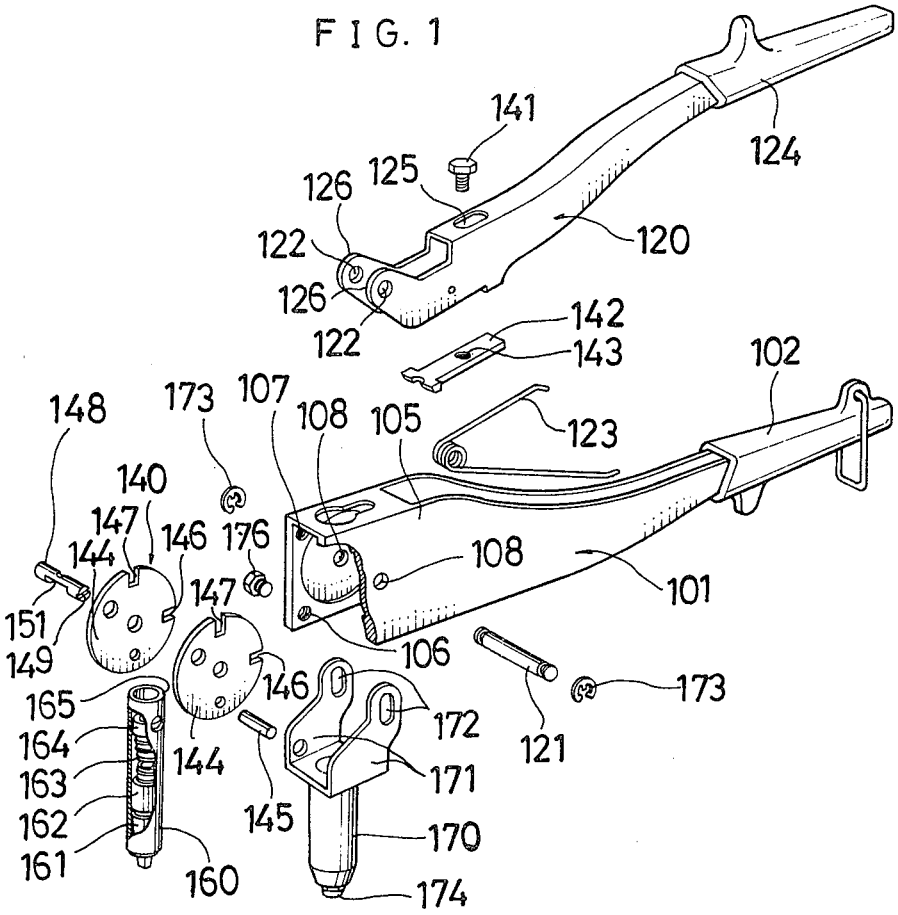
FIG. 1 is an exploded perspective view partly broken away and showing an embodiment of the present invention.
Figure 2:
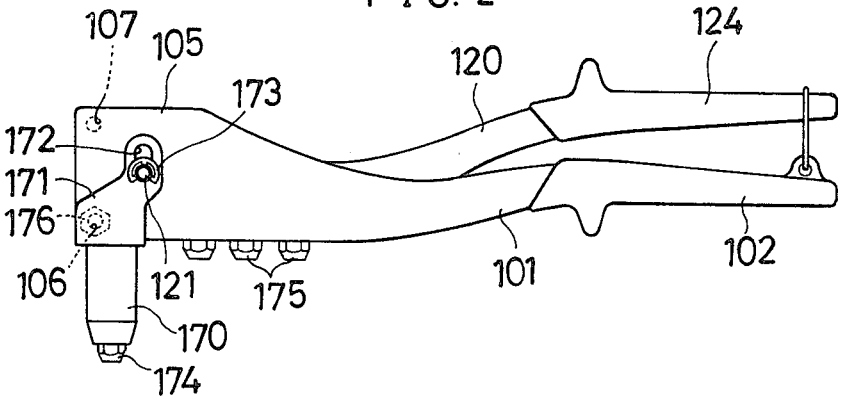
FIG. 2 is a front view showing the same embodiment.
Figure 3:
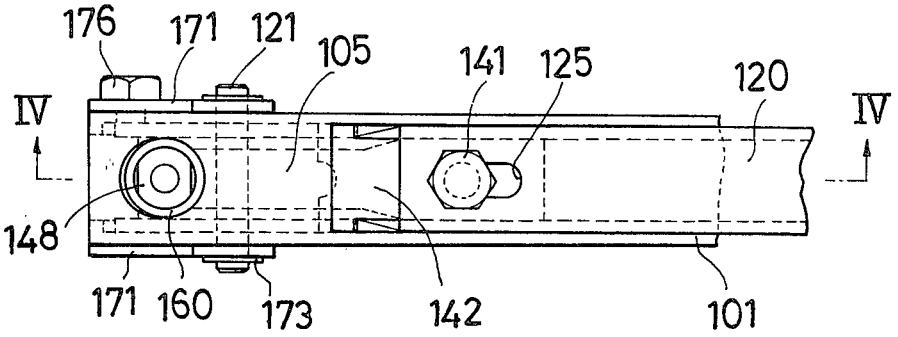
FIG. 3 is a fragmentary plan view.

With reference to FIGS. 1 to 13, an embodiment of the invention will be described first. The illustrated hand riveter has a frame main body 101 including a handle portion 102 at its rear end and a head frame 105 at its forward end. The head frame 105 is in the form of a case having a small width and opened on the front and under sides. The head frame has one side wall formed with an upper threaded bore 107 and a lower threaded bore 106 at the front end for positioning the jaw case tubular housing to be described later.

A lever 120 is supported by a pivot 121 on the frame main body 101. The pivot 121 extends through holes 108, 108 formed in the opposite side walls of the head frame 105 and through holes 122, 122 formed in the forward end of the lever 120. The lever 120 is biased upward by a spring 123 at all times and has a handle portion 124 at its rear end. The lever 120 has a slot 125 extending longitudinally thereof and formed in an upper wall front end portion thereof. A bolt 141 inserted through the slot 125 is screwed in a threaded bore 143 in an engaging pawl 142, whereby the engaging pawl 142 is attached to the lever 120 movably longitudinally of the lever.

An actuating support member 140 for a jaw assembly is disposed within the head frame 105 and turnably mounted on the pivot 121 for supporting the lever 120 on the frame main body 101. The actuating support member 140 comprises a pair of turnable disks 144, 144 connected together by a bar 145 as opposed to each other and spaced apart by a predetermined distance. Each of the disks 144 is formed in its peripheral edge with two cutouts 146, 147 angularly spaced apart from each other by about 90°. The cutouts 146, 147 of one of the disks 144 are in register with the corresponding cutouts 146, 147 of the other disk 144. A support pin 148 extends between and is supported by the disks 144, 144 which are disposed within the head frame 105 and turnably mounted on the pivot 121 as already described. The support pin 148 is positioned on one side of the disk 144 opposite to the center of the cutout 146 (preferably as displaced from the cutout 146 angularly through about 180°). A jaw case 160 is pivotably supported by the pin 148. The pin 148 has a groove 149 in one end.

The jaw case 160 houses jaws 161, a jaw pusher 162, a jaw pusher pressing spring 163, and a spring seat 164 which is fitted in a recess 151 formed in the pin 148.

A tubular housing 170 for inserting the jaw case 160 therein has bifurcated attaching pieces 171, 171 upwardly extending from its upper end. The head frame 105 is disposed between the attaching pieces 171, 171. A slot 172 extending axially of the housing 170 in formed in the upper end of each attaching piece 171. A retaining ring 173 is engaged with each end of the pivot 121 extending through the slot 172 and turnably supporting the tubular housing 170 on the head frame 105 of the frame main body 101. The jaw case 160 is fitted in the housing 170, which has a nose piece 174 screwed in its lower end. Interchangeable nose pieces 175 of different sizes are screwed in the under wall of the frame main body 101.

Figure 4:
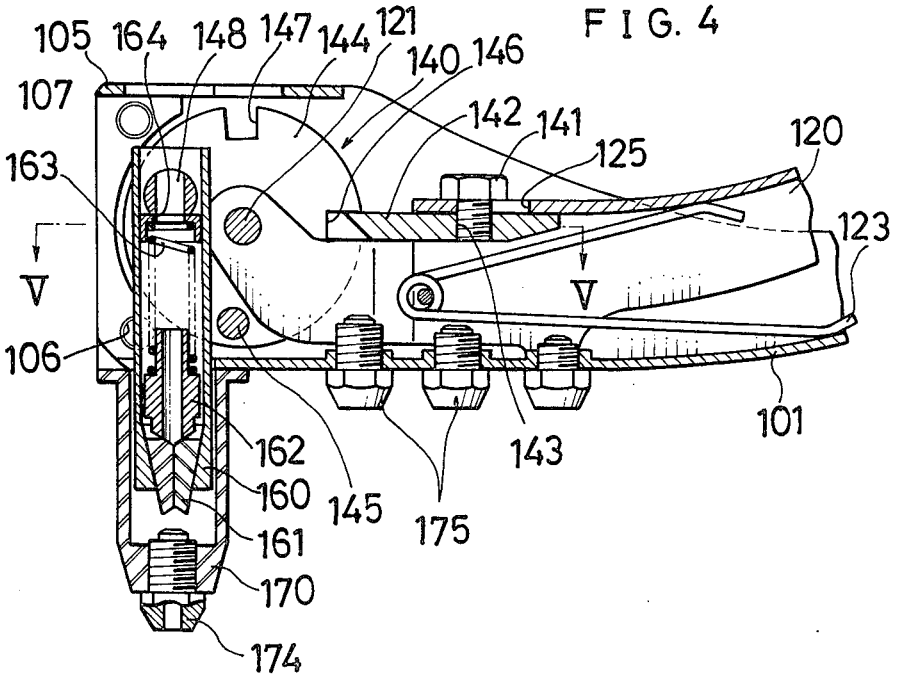
FIG. 4 is a view in vertical section taken along the line IV—IV in FIG. 3.
Figure 5:
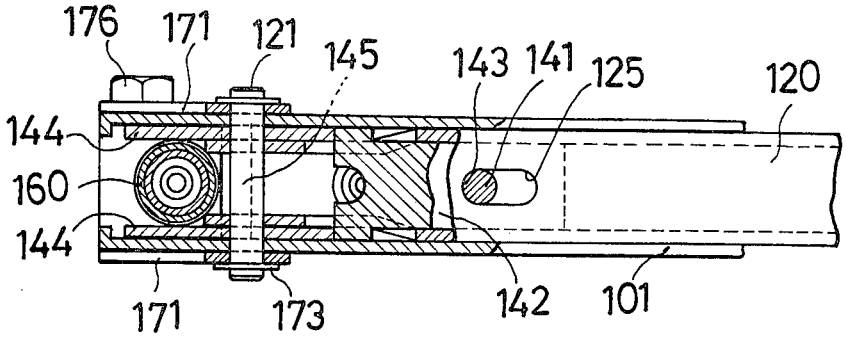
FIG. 5 is a plan view in section taken along the line V—V in FIG. 4.
Figure 6:
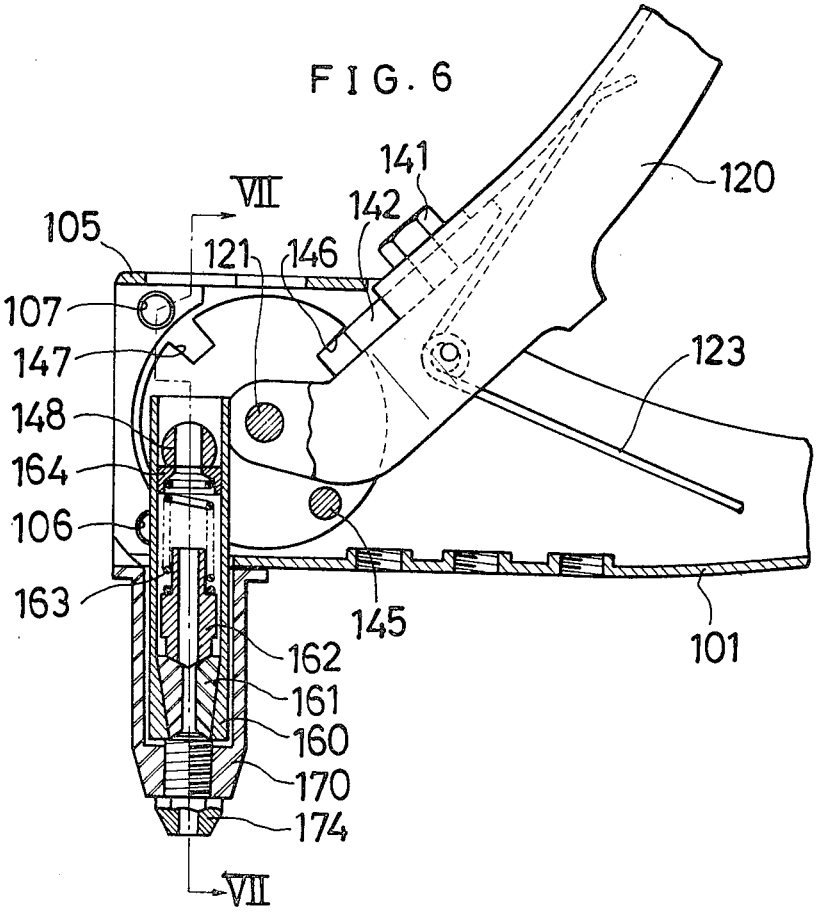
FIG. 6 is a fragmentary view in vertical section showing the embodiment with a lever in its opened position.
Figure 7:
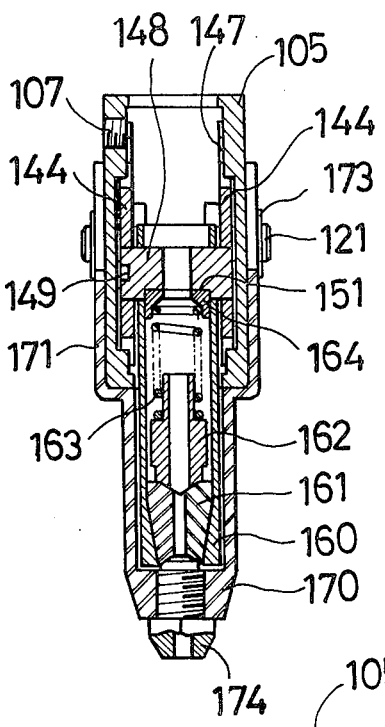
FIG. 7 is a fragmentary view in cross section taken along the line VII—VII in FIG. 6.

With the riveter of the foregoing construction, the jaw assembly is set in its downward position shown in FIG. 4 in the following manner. The bolt 141 is loosened, and the engaging pawl 142 is slidingly advanced to engage its front end in the cutouts 146 of the disks 144. The pawl 142 is then fastened to the lever 120 by tightening up the bolt 141. The housing 170 having the jaw case 160 therein is retained in a vertical position and then fastened to the head frame 105 by screwing a bolt 176 in the threaded bore 106 of the frame.

Figure 8:
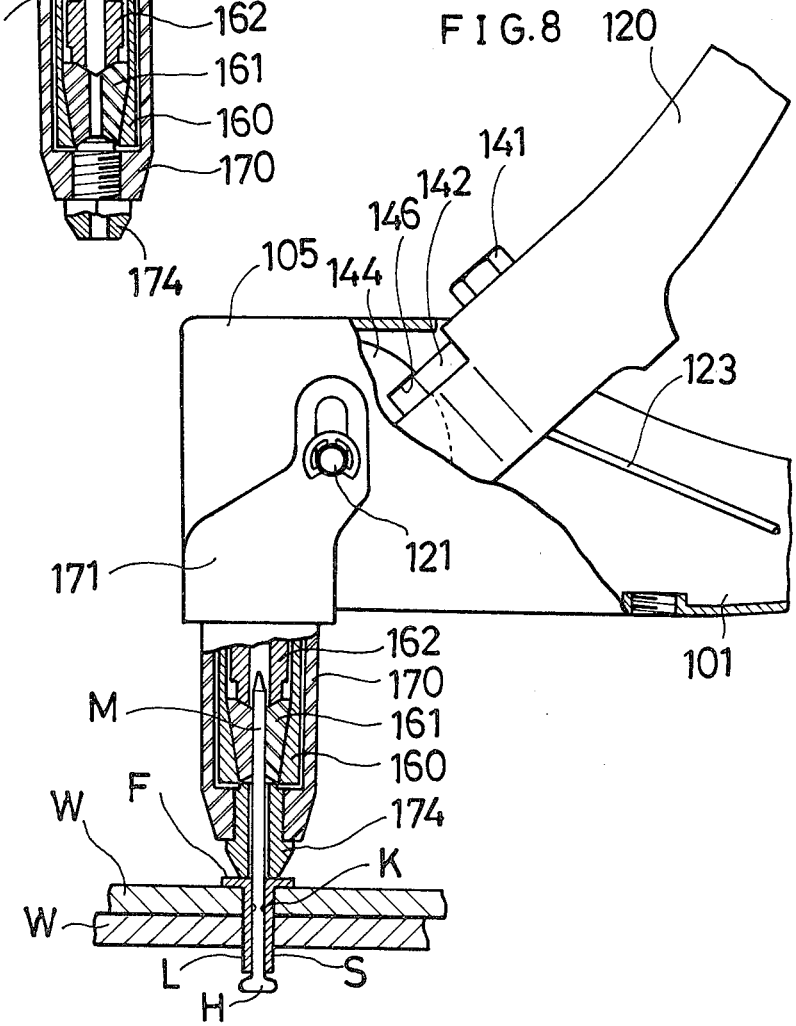
FIGS. 8 to 10 are fragmentary front views partly broken away and showing a rivet setting process, FIG. 8 being a view showing a mandrel gripped by jaws.
Figure 9:
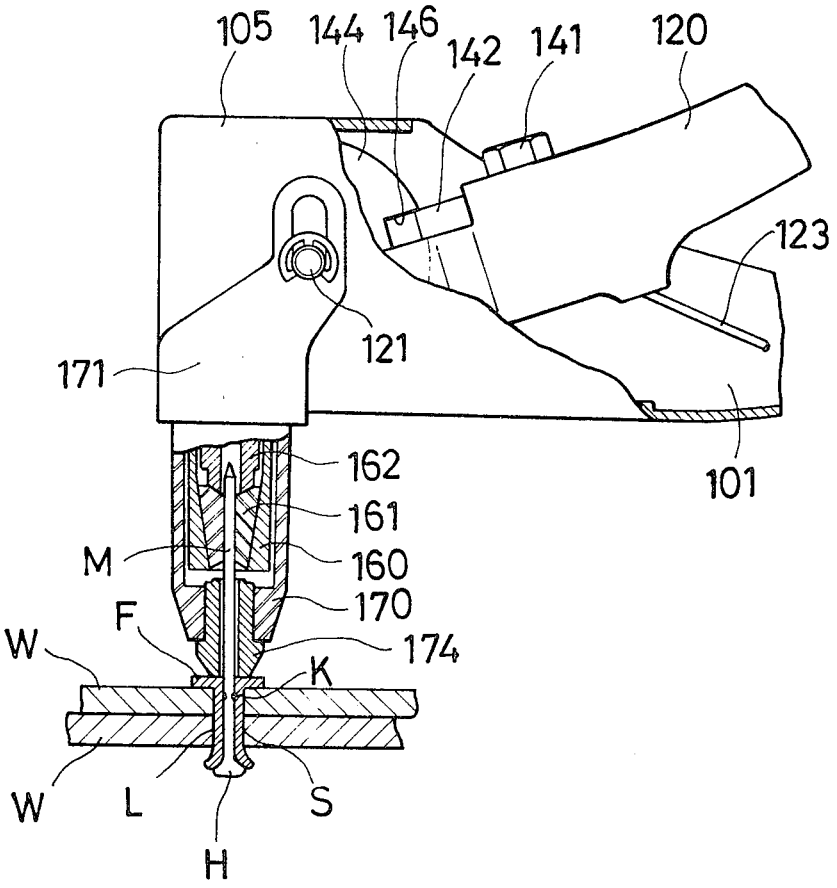
Figure 10:
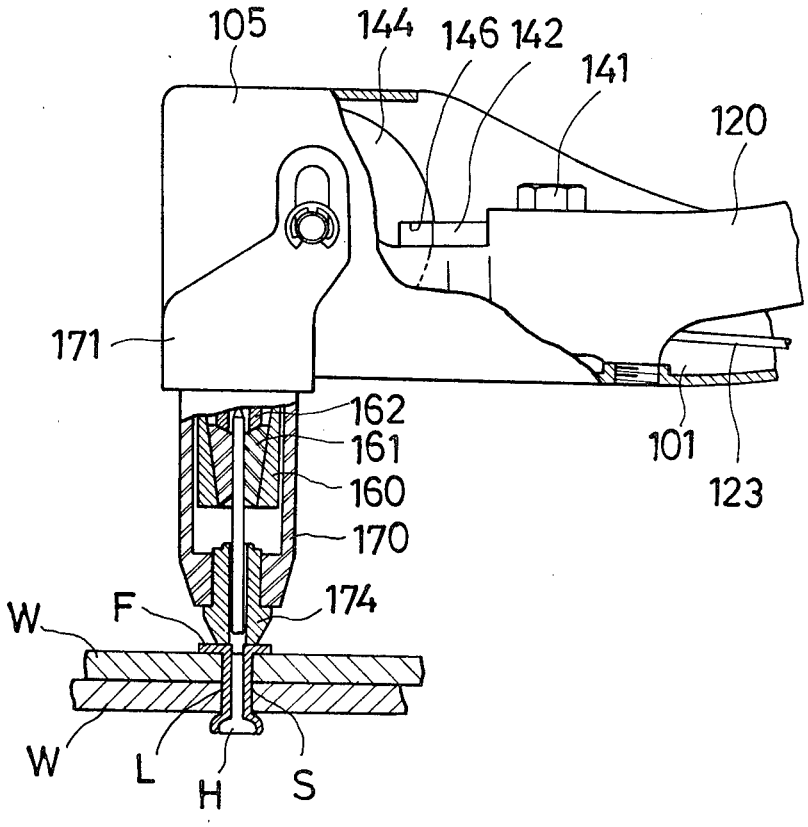
Figure 11:
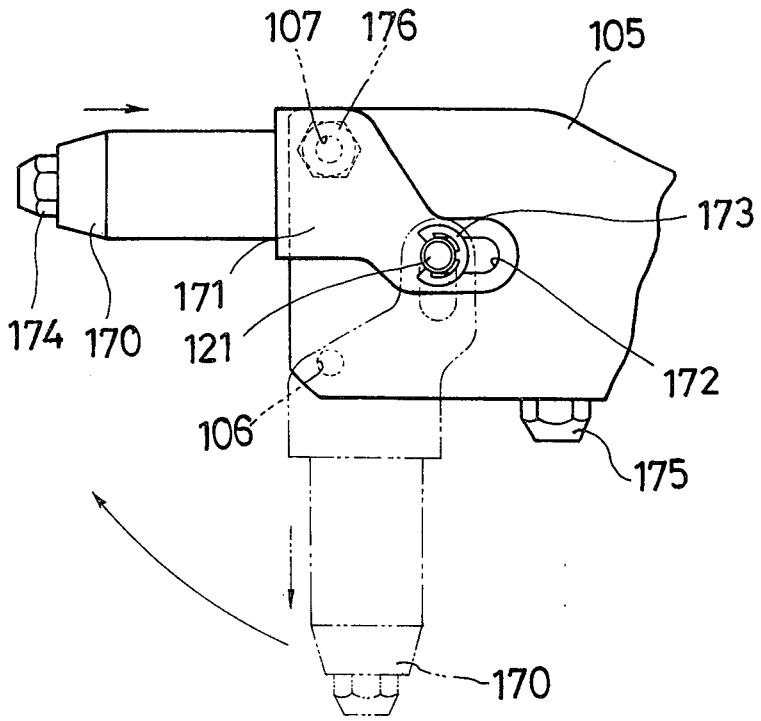
FIG. 11 is a fragmentary view showing the jaw assembly changed-over to its forward position.

The riveter is used for riveting in the following manner. The mandrel M of a blind rivet L is inserted through a sleeve S, then inserted through the nose piece 174 and gripped at its forward end by the jaws 161 in the jaw case 160 as seen in FIG. 8. At this time, the lever 120 is held away from the frame main body 101 by the force of the spring 123. With the sleeve S of the rivet L then inserted through a bore formed in the workpieces W, W to be fastened together, the handle portions 102, 124 of the frame main body 101 and the lever 120 are gripped by hand to turn the lever 120 toward the frame main body 101 as shown in FIG. 9. Since the lever 120 is coupled to the actuating support member 140 for the jaw assembly by the engaging pawl 142, the member 140 rotates about the pivot 121 with the turn of the lever 120. The rotation of the member 140 to which the jaw case 160 is pivoted by the pin 148 pulls the jaw case 160 upward. Thus the turn of the lever 120 pulls up the mandrel M. Since the nose piece 174 bears against a flange F at the base end of the sleeve S and restrains the sleeve S from moving, the head H of the mandrel M is forced into the sleeve S to deform the sleeve S. Consequently the sleeve S is fully deformed as shown in FIG. 10 to firmly fasten the workpieces W, W together, while the mandrel M is snapped at a constricted portion K. The rivet is now completely set in the workpieces.

Figure 12:
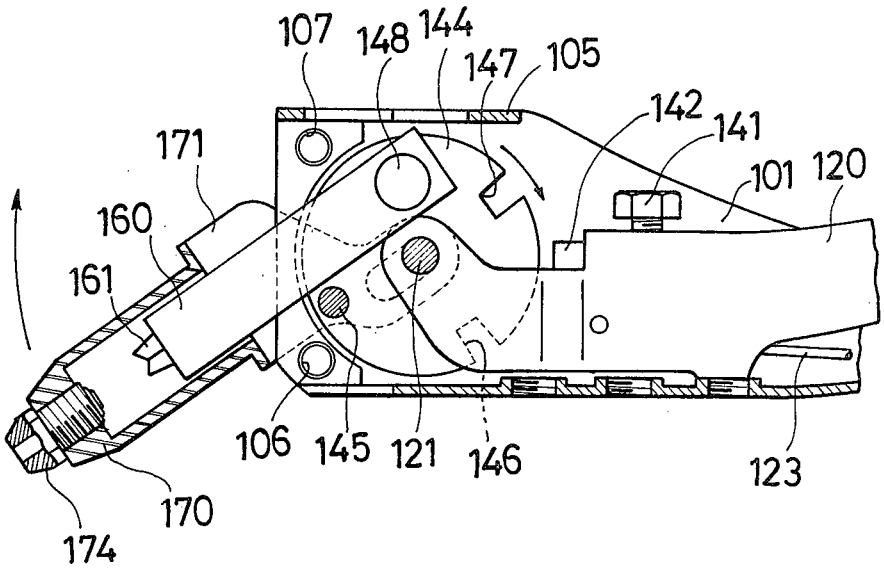
FIG. 12 is a fragmentary view in vertical section showing the jaw assembly during change-over.
Figure 13:
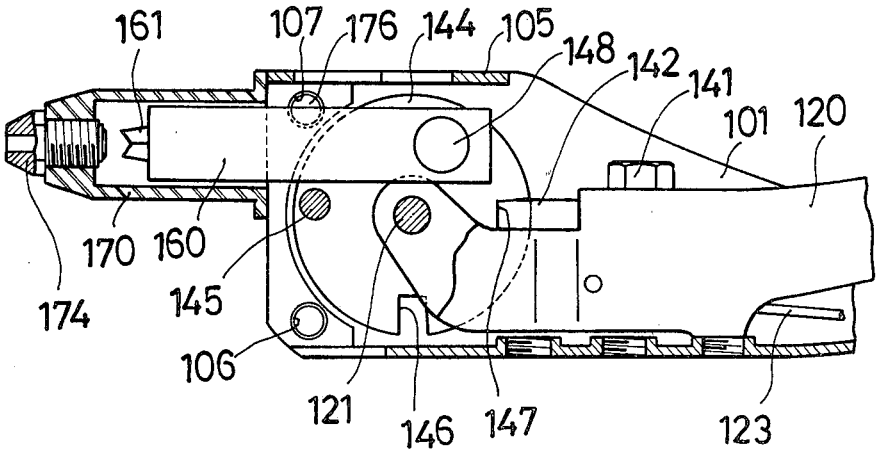
FIG. 13 is a fragmentary view in vertical section showing the jaw assembly in its forward position.

To set the jaw assembly alternatively in its forward position, the bolt 141 is loosened first, the engaging pawl 142 is then retracted to release the actuating support member 140 from the lever 120, and the bolt 176 is loosened to release the tubular housing 170. The housing 170 is pulled down along the slots 172 to the broken-line position shown in FIG. 11, then turned forward and thereafter horizontally retracted along the slots 172 to the solid-line position in FIG. 11. The housing 170 is fixed to the head frame 105 again by screwing the bolt 176 in the other threaded bore 107. When the housing 170 turns forward, the jaw case 160 housed therein is also turned as seen in FIG. 12, with upper opposite side portions 165 of the case 160 in bearing contact with front end portions 126 of the lever 120, the contact portions therefore serving as support points for causing the jaw assembly actuating support member 140 to rotate about the pivot 121 with the turn of the housing 170. Subsequently the engaging pawl 142 is slidingly moved forward into engagement with the other cutout portions 147, 147 of the disks 144, 144. The bolt 141 is tightened up to couple the lever 120 to the actuating support member 140. The jaw case 160 and the lever 120 can be so dimensioned that the upper side portions 165 of the former will not contact the front end portions 126 of the latter when the housing 170 is turned. In this case, the actuating support member 140 may be made rotatable by suitable means.

According to the present invention, therefore, the jaw assembly of the riveter is easily shiftable from forward position to downward position, and vice versa.

Although not shown, the engaging pawl 142 on the lever 120 can be made movable forward or backward with use of a spring.

According to the embodiment, the means for coupling the lever to the actuating support member for a jaw assembly to rotate the member by the turn of the lever comprises an engaging pawl 142 provided on a forward end upper portion of the lever and movable forward and backward, and cutout portions 146, 147 formed in the cuter peripheral edge of the actuating support member 140.

The coupling means nevertheless is not limited to these arrangements but can be modified variously as will be described below.

Although unillustrated, the actuating support member of the embodiment, for example, may be provided with an engaging pawl which is engageable in cutouts formed in the lever.

Although not shown, the invention includes a gear-and-rack arrangement for coupling the lever to the actuating support member, a screw-thread arrangement for coupling these members, etc.

Figure 14:
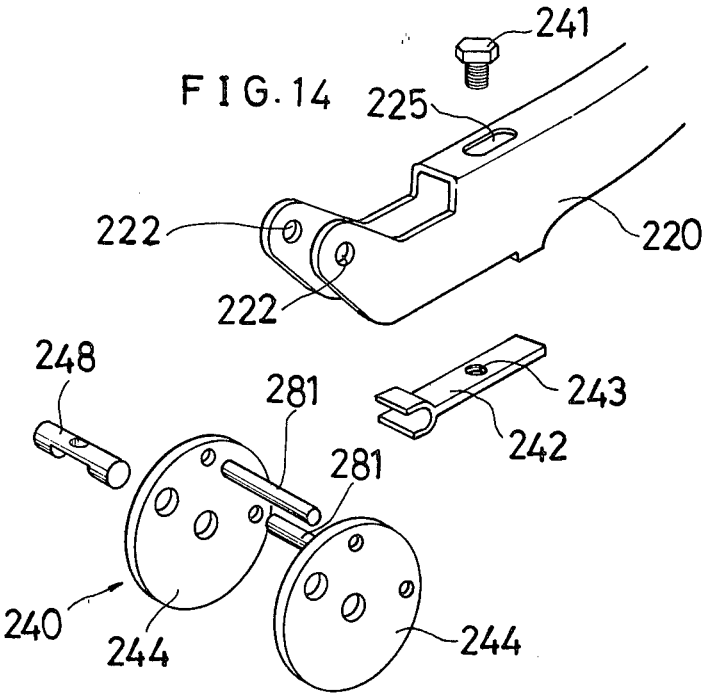
FIG. 14 is a perspective view showing modified coupling means.
Figure 15:
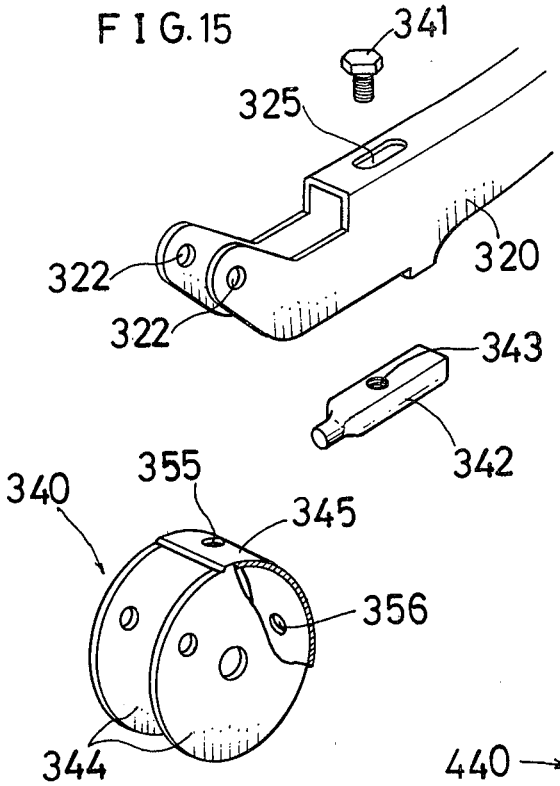
FIG. 15 is a perspective view partly broken away and showing another modified coupling means.

With reference to FIG. 14, an actuating support member 240 comprises a pair of side disks 244, 244 interconnected by pins 281. A hook 242 movably mounted on a lever 220 is engageable with either one of the pins 281 to couple the lever 220 to the support member 240. The actuating support member 340 shown in FIG. 15 comprises a pair of side disks 344, 344 connected together by a plate 345 which is formed with holes 355 and 356. An engaging bar 342 movably mounted on a lever 320 is engageable in the hole 355 or 356 to couple the lever to the support member 340.

Figure 16:
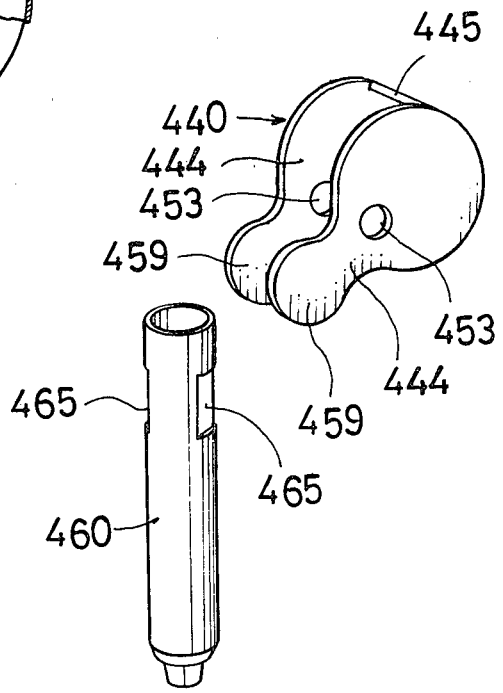
FIG. 16 is a perspective view showing a modification of the means for supporting a jaw case on an actuating support member.

While the support pin 148 is used for pivotably supporting the jaw case on the actuating support member, an actuating support member 440 and a jaw case 460 are similarly useful as seen in FIG. 16. The actuating support member 440 comprises a pair of side plates 444, 444 connected together by a plate 445. Each of the side plates 444 has a constricted midportion and resembles a cocoon. The side plate 444 has a hole 453 at the midportion for inserting a pivot therethrough. The plate 445 is formed with two holes angularly displaced from each other through 90° for passing an engaging bar therethrough. The other side of the plate 444 opposite to the plate 445 serves as a support portion 459 having a circular arc periphery. Parallel cutout portions 465, 465 are formed in an upper portion of the jaw case 460 on th opposite sides thereof. The support portions 459 of the actuating member 440 are engageable with the cutout portions 465, 465 in sliding contact therewith to turnably support the jaw case 460 on the member 440.

With the riveter of this invention which has the foregoing construction, the jaw assembly is easily shiftable either to a forward position or to a downward position as desired. The riveter therefore has the distinct advantage that rivets can be set in an optimum condition in accordance with the shape of the work to be riveted and with other requirements concerned, thus assuring rivet setting with a greatly improved efficiency without necessitating different kinds of riveters.

I claim:

1. A riveter having a lever (120, 220, 320) pivoted to a frame main body (101) and reciprocally turnable relative to the frame to reciprocate a jaw case (160, 460), the riveter comprising a turnable jaw case actuating support member (140, 240, 340, 440) disposed within a forward end portion of the frame main body (101) and mounted on a pivot for supporting the lever (120, 220, 320) on the frame main body (101), coupling means capable of locking the actuating support member (140, 240, 340, 440)

in a plurality of positions relative to the lever (120, 220, 320) and displaced from each other through a predetermined angle ($\theta$), the jaw case (160, 460) being turnably supported by the actuating support member (140, 240, 340, 440) eccentrically of the pivot and reciprocally movable straight by reciprocal turn of the lever (120, 220, 320) through reciprocal turn of the actuating support member (140, 240, 340, 440) connected thereto, and a jaw case tubular housing (170) turnably supported by the forward end portion of the frame main body (101) and lockable in a plurality of positions angularly spaced from each other by the same angle as the angle of displacement ($\theta$).

2. A riveter as defined in claim 1 wherein the coupling means comprises an engaging pawl (142) provided on a forward end upper portion of the lever (120) and movable forward and backward, and a plurality of cutout portions (146, 147) formed in the outer peripheral edge of the actuating support member (140) and angularly spaced apart by the angle ($\theta$).

3. A riveter as defined in any one of claims 1 to 2 wherein the predetermined angle ($\theta$) is 90 degrees, and the jaw case (160) is lockable in each of downward position and forward position relative to the frame main body (101).

* * * * *